US005236409A

United States Patent [19]

Romanauskas

[11] Patent Number: 5,236,409

[45] Date of Patent: Aug. 17, 1993

[54] CARTRIDGE ADAPTER HAVING A SECONDARY SEAL

[75] Inventor: William A. Romanauskas, Southbury, Conn.

[73] Assignee: E. I. du Pont de Nemours and Company, Wilmington, Del.

[21] Appl. No.: 787,871

[22] Filed: Oct. 31, 1991

[51] Int. Cl.[5] ..... B04B 5/02

[52] U.S. Cl. ..... 494/85; 215/286; 494/16

[58] Field of Search ..... 494/85, 16–21, 494/45, 37; 215/273, 280, 286; 422/71, 104

[56] References Cited

U.S. PATENT DOCUMENTS

| | | | |
|---|---|---|---|
| 282,188 | 7/1883 | Gilberds | 215/286 |
| 328,115 | 10/1885 | Gilberds | 215/286 |
| 3,674,197 | 7/1972 | Mitchell et al. | 233/14 R |
| 3,918,920 | 11/1975 | Barber | 23/292 |
| 3,998,383 | 12/1976 | Romanauskas et al. | 233/26 |
| 4,015,775 | 4/1977 | Rohde | 233/26 |
| 4,030,663 | 6/1977 | Conn et al. | 233/26 |
| 4,032,066 | 6/1977 | Wright | 233/26 |
| 4,087,043 | 5/1978 | Anderson et al. | 233/26 |
| 4,235,367 | 11/1980 | Davidson | 233/26 |
| 4,285,904 | 8/1981 | Ishimaru et al. | 264/322 |
| 4,290,550 | 9/1981 | Chulay et al. | 233/26 |
| 4,301,963 | 11/1981 | Nielsen | 233/26 |
| 4,304,356 | 12/1981 | Chulay et al. | 233/26 |
| 4,306,676 | 12/1981 | Edwards et al. | 233/26 |
| 4,360,150 | 11/1982 | Ishimaru et al. | 233/26 |
| 4,360,151 | 11/1982 | Cowell et al. | 233/27 |
| 4,372,483 | 2/1983 | Wright | 494/16 |
| 4,451,250 | 5/1984 | Romanauskas | 494/85 |
| 4,552,278 | 11/1985 | Romanauskas | 215/277 |
| 4,692,137 | 9/1987 | Anthony | 494/85 |
| 5,024,646 | 6/1991 | Lewis et al. | 494/16 |

OTHER PUBLICATIONS

Nalgene Product News, vol. 8, No. 1, 1989.

*Primary Examiner*—Robert W. Jenkins

[57] ABSTRACT

An adapter having a body and a cooperating cover with a seal therebetween is characterized by a stop surface provided on the exterior surface the body. The body and the cover are held together by a clamping bail that is either separate from or, more preferably, pivotally mounted to, the body. The bail is slidably movable over the body and the cover from an open to a clamping position. In the clamping position the bail abuts against the stop surface with the major axis of the bail being most preferably collinear with the major axis of the adapter. With the bail in the clamping position the cover is held to the body in a manner that compresses the seal therebetween. The bail is formed of a material having sufficient strength to withstand a vertical force created by the pressure of a liquid carried in the tube under centrifugation.

20 Claims, 7 Drawing Sheets

CARTRIDGE ADAPTER HAVING A SECONDARY SEAL

BACKGROUND OF THE INVENTION

1. Field of the Invention

The present invention relates to an adapter for holding a centrifuge tube in a centrifuge rotor cavity, and in particular, to an adapter in which a secondary seal is disposed between the pieces and in which the pieces are held by a bail.

2. Description of the Prior Art

U.S. Pat. No. 3,998,383 (Romanauskas et al.) and U.S. Pat. No. 4,015,775 (Rohde), both assigned to the assignee of the present invention, disclose centrifuge rotors of the vertical angle type. U.S. Pat. No. 5,024,646 (Lewis et al.) discloses a centrifuge rotor having tube cavities that are nearly vertical, i.e., having an angle of approximately ten degrees or less with respect to the axis of rotation.

In such rotors the axis of the rotor cavities is substantially parallel to the axis of rotation. When using a vertical angle or near-vertical angle rotor it is necessary that a cap be provided at the mouth of each cavity to impose a vertical restraining force on the tube disposed in the cavity. Even though the tube may be disposed in an adapter received within the cavity, without such a capping arrangement the possibility exists that the pressure of the liquid during centrifugation may rupture the tube. U.S. Pat. No. 3,998,383 (Romanauskas et al.) exemplifies a typical capping arrangement for a vertical angle rotor.

Such capping arrangements must be individually threaded into the rotor body. As a result such capping assemblies present, at a minimum, a tortuous path for preventing the escape of aerosols formed in the event of tube rupture. In this regard, such capping assemblies are advantageous in that they satisfy the increasing demand to provide secondary sealing for sealed tubes or containers having biohazardous materials. However, in order to provide proper support, it is necessary that the capping arrangement be in intimate contact with the tube. Improper assembly can thus lead to the possibility of tube rupture and/or cap failure. For these reasons such capping arrangements have an associated disadvantage.

Recently, however, due primarily to the hazardous nature of many of the materials being processed, the demand has increased to provide a secondary seal for the sample carried within a container tube within the rotor.

In view of the foregoing it is believed advantageous to provide an adapter for use in a vertical or near vertical angle rotor that eliminates the necessity of a capping mechanism for the rotor cavity and simultaneously affords a secondary seal to prevent the escape of biohazardous materials.

A sealed centrifuge tube adapted for use in rotors is sold by E. I. Du Pont de Nemours & Co. as the "ULTRACRIMP" TM tube. The sealing assembly for this tube is disclosed in U.S. Pat. No. 4,552,278 (Romanauskas), assigned to the assignee of the present invention. Other sealed centrifuge tubes are disclosed in U.S. Pat. No. 4,301,963 (Nielsen), heat sealable in the manner disclosed in U.S. Pat. No. 4,291,964 (Ishimaru), and those manufactured and sold by Nalgene Inc. as the "UltraLok" tube sold by Fisher Scientific Incorporated.

U.S. Pat. No. 4,306,676 (Edwards et al.) discloses a two-piece adapter for supporting multiple open-mouthed tubes at a predetermined angle with respect to the axis of rotation in a vertical rotor cavity. A gasket is disposed between the conjoined pieces of the adapter. The pieces of the adapter are held together by a bail whose major axis extends perpendicular to the major axis of the adapter. Owing to the manner in which the bail is mounted, such an adapter would appear incapable of resisting a vertical force.

U.S. Pat. No. 3,674,197 (Mitchell et al.), assigned to the assignee hereof, the above-mentioned Nalgene Ultra-Lok Tube System, and U.S. Pat. No. 4,692,137 (Anthony) each also disclose an adapter arrangement formed of two discrete adapter segments.

SUMMARY OF THE INVENTION

The present invention relates to an adapter for adapting a sealed centrifuge tube to the cavity of a vertical or near vertical centrifuge rotor without the necessity of a separate cavity capping arrangement. In addition, the adapter in accordance with the present invention includes a secondary seal that prevents the escape of biohazardous aerosols in the event of tube rupture within the adapter during operation of the rotor.

The adapter comprises a body and a cooperating cover, each of which having an exterior surface thereon. Both the body and the cover have an opening therein that cooperate to define a recess sized to totally surround a centrifuge tube when the cover is mounted to the body. The adapter has a major axis extending therethrough. The recess of the adapter may be inclined at a predetermined angle with respect to the major axis of the adapter.

At least one of the cover or the body has a stop surface provided on the exterior surface thereof. Preferably, the stop surface is disposed on the exterior surface of the cover and along the exterior surface of the body for substantially the full length thereof. A seal is disposed between the cover and the body.

The body and the cover are held together by a clamping bail member having a major axis extending therethrough. The bail may be either separate from or, more preferably, pivotally mounted to the body. The bail is slidably movable over the body and the cover from an open to a clamping position. In the clamping position the bail abuts against the stop surface with the major axis of the bail being generally parallel to (and more preferably substantially parallel to, and most preferably collinear with) the major axis of the adapter. With the bail in the clamping position the cover is held to the body in a manner that compresses the seal therebetween. The bail is formed of a material having sufficient strength to withstand a vertical force created by the pressure of a liquid carried in the tube under centrifugation.

If the cavity of the rotor, or a predetermined portion thereof, has a predetermined noncircular shape, then the exterior surfaces of the cover and/or body (or at least a portion of the body) cooperate to impart a shape to the adapter that precludes rotation of the adapter within the cavity.

BRIEF DESCRIPTION OF THE DRAWINGS

The invention will be more fully understood from the following detailed description thereof taken in connection with the accompanying drawings, which form a part of this application, and in which:

FIG. 7 is a section view similar to that of FIG. 5 illustrating the adapter of FIG. 6 received within a cavity of a centrifuge rotor, while

DETAILED DESCRIPTION OF THE INVENTION

Figure 1:
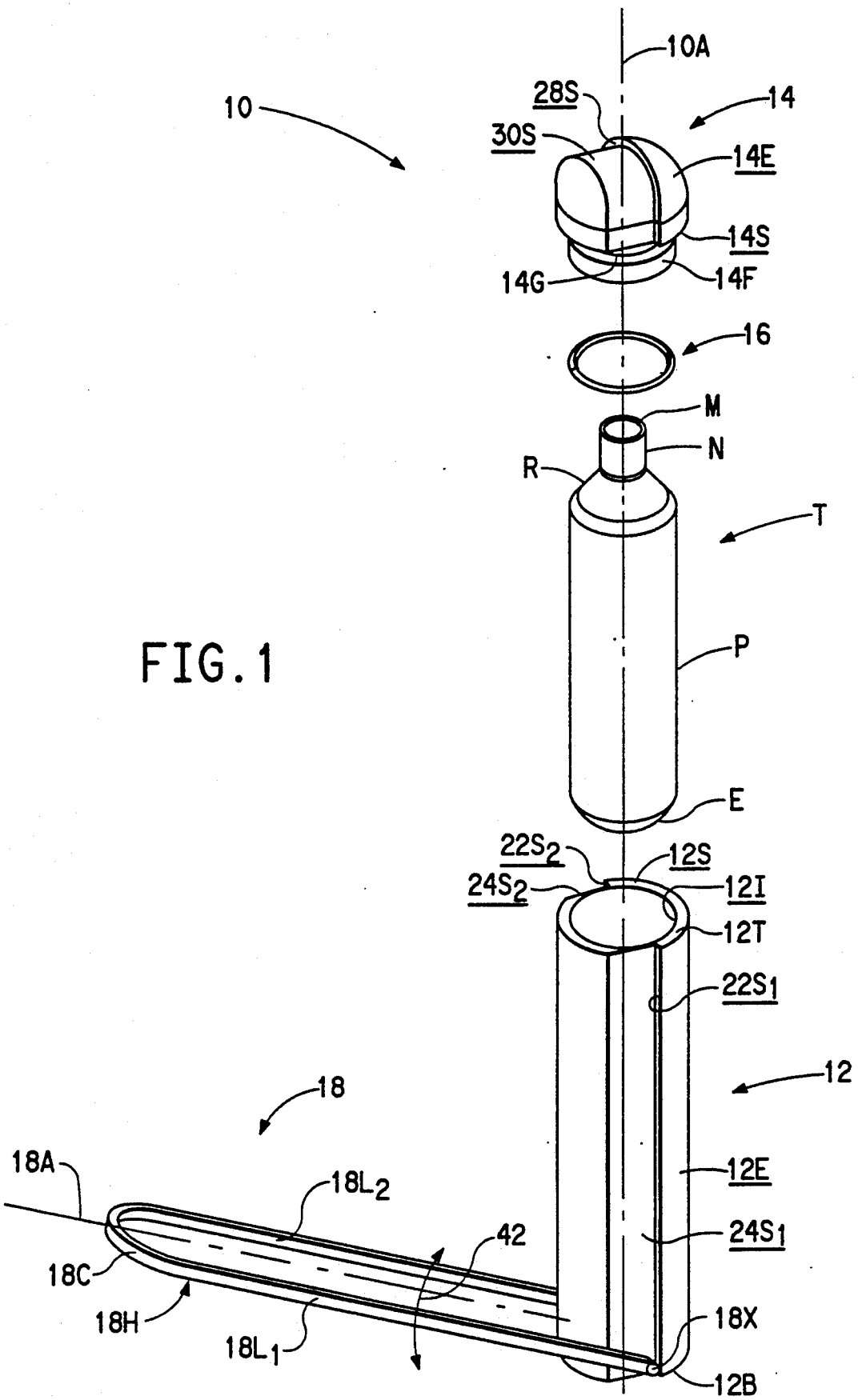
FIG. 1 is an exploded perspective view of an adapter having a body and a cover secured by a clamping bail member in accordance with a first embodiment of the present invention in which the bail is pivotally mounted to the body.

Throughout the following detailed description, similar reference numerals refer to similar elements in all figures of the drawings.

Figure 3:
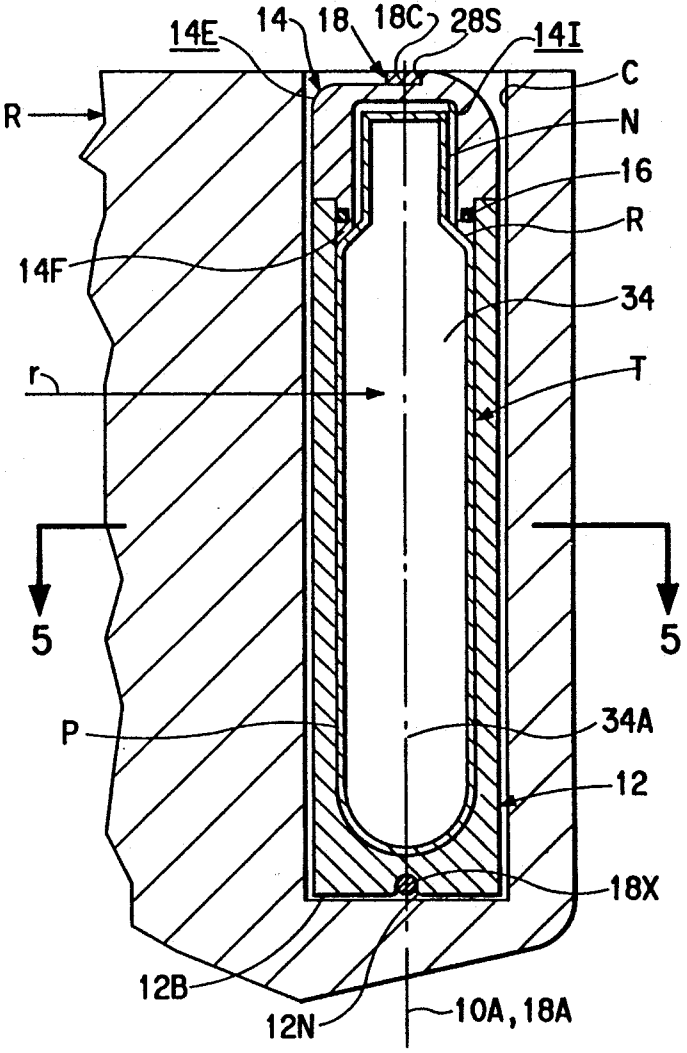
FIGS. 3 and 4 are side elevational views, in vertical section, respectively illustrating an adapter of FIG. 1 and FIG. 2 as received within a cavity of a rotor.

FIG. 1 shows an exploded perspective view of an adapter, generally indicated by the reference character 10 according to a first embodiment of the present invention. The adapter 10 is useful for supporting a centrifuge tube T within a cavity C of a centrifuge rotor R (FIG. 3). The tube T includes a container portion P with a closed end E and an open mouth M. The container portion P tapers through a transition region R to a narrowed neck region N. The neck region N has the mouth opening M therein which defines the liquid port through which a liquid under test may be loaded into the tube T. Preferably a capping assembly as disclosed in U.S. Pat. No. 4,552,278 (Romanauskas) is used to cap the tube. However, it should be understood that any other capping or sealing arrangement may be used to seal the tube T so long as the seal is capable of withstanding the high liquid pressure that develops during centrifugation.

The adapter 10 comprises a body member 12, a corresponding cover 14, a seal 16, and a clamping bail member 18. The adapter 10 and the bail 18 each have a major axis 10A, 18A, respectively, extending therethrough.

The body 12 is an elongated, generally cylindrical member with an exterior surface 12E thereon and an interior opening 12I therein. The body 12 has a first, closed, bottom end 12B and a second, open, top end 12T with a top surface 12S thereon. As will be developed, at least the outboard half of the exterior surface 12E generally corresponds to the size and shape of the cavity C of the centrifuge rotor R in which the adapter 10 is disposed.

The exterior surface 12E of the body 12 is interrupted by at least one but, in the preferred instance, a pair of stop surfaces $22S_1$, $22S_2$. The stop surfaces $22S_1$, $22S_2$ extend in a generally axial direction (with respect to the axis 10A of the adapter) along diametrically opposed lateral portions of the body 12. Preferably, the stop surfaces $22S_1$, $22S_2$ extend for substantially the entire length of the lateral portions of the exterior surface of the body 12. Also, in the most preferred instance, the stop surfaces $22S_1$, $22S_2$ are arranged such that when the bail 18 is in contact therewith the axis 18A of the bail is collinearly aligned with the major axis 10A of the adapter.

It should be understood, however, that the adapter is operative even though the stop surfaces of the adapter are inclined with respect to the major axis 10A of the adapter 10. For most uses it is sufficient that the axes of the stop surfaces $22S_1$, $22S_2$ are substantially parallel to the major axis of the adapter. By "substantially parallel" it is meant that for a tube having a diameter to length ratio of about 1:2, the axes of the stop surfaces $22S_1$, $22S_2$ are inclined less than twenty degrees (20°) with respect to the major axis of the adapter. Moreover, in some instances, it may be sufficient that the axes of the stop surfaces $22S_1$, $22S_2$ are generally parallel to the major axis of the adapter. By "generally parallel" it is meant that for a tube having a diameter to length ratio of about 1:2, the axes of the stop surfaces $22S_1$, $22S_2$ may be inclined up to thirty five degrees (35°) with respect to the major axis 10A of the adapter 10.

The body 12 has generally flattened portions defined thereon adjacent to the stop surfaces $22S_1$, $22S_2$. These flattened portions define slide surfaces $24S_1$, $24S_2$ provided for a purpose to be described. The body 12 is preferably manufactured from suitable plastic material, such as polypropylene, polyamide, acetal, polyphenylene oxide, polyvinyl chloride, polycarbonate or polyethylene. Other plastic or metallic materials (either homogenous (neat) or fiber reinforced) with similar or better mechanical and chemical properties for the application under consideration may also be used.

The cover 14 is a generally dome shaped member which may also be fabricated from the same materials as the body 12, and is removably engagable to the body 12. The cover 14 serves to define a closure cap for the opening 12I of the body 12. The cover 14 has an exterior surface 14E with a surface 14S thereon. To facilitate the mounting of the cover 14 to the body 12, a depending flange 14F is formed integrally with the cover 14. The flange 14F is provided with a peripheral gland, or groove, 14G therein. The cover 14 has an internal opening 14I (FIG. 3) provided therein. In the most preferable case the exterior surface 14E of the cover 14 has a stop surface 28S and an adjacent flattened slide surface 30S. Both the stop surface 28S and the adjacent slide surface 30S extend peripherally with respect to the cover 14. These surfaces are located on the cover 14 in a manner such that, when the cover 14 is attached to the body 12, each end of the stop surface 28S registers with the stop surface $22S_1$ or with the stop surface $22S_2$, as the case may be. Similarly each end of the slide surface 30S registers with a slide surface $24S_1$ or the slide surface $24S_2$.

The internal openings 12I, 14I, respectively provided in the body 12 and in the cover 14, cooperate to form an internal recess 34 (FIG. 3). The internal recess 34 conforms closely in size and shape to the exterior surface of the tube T. The tube T when received within the recess 34 is totally surrounded by and supported by the body 12 and the cover 14 of the adapter. The internal recess 34 has a central axis 34A extending therethrough. In the embodiment of FIG. 1, the central axis 34A is collinear with the axis 10A of the adapter 10, although, as may be seen in FIG. 9, such an arrangement need not necessarily be the case. As is apparent from FIG. 9, the internal recess 34 may be arranged within the body 12 and the cover 14 such that the central axis 34A extending through the recess 34 defines a predetermined angle 36 with respect to the axis 10A of the adapter 10. Although the angle 36 preferably lies in the "near vertical" range, that is, in the range from approximately zero to approximately fifteen degrees (15°), the angle 36 may be any convenient value consistent with the separation being performed.

The seal 16 is normally retained in the gland 14G on the flange 14F of the cover portion 14. Preferably, the seal is implemented using an O-ring arranged in either a piston seal or a face seal arrangement. The seal member 16 is formed from a suitable elastomeric material compatible with the liquid under test. The seal 16 is removable for cleaning or replacement.

The adapter 10 further includes the clamping bail member 18 having a major axis 18A therethrough. The bail 18 is a closed bank-like member defined by two opposed substantially straight legs $18L_1$, $18L_2$, an arcuate loop connecting portion 18C and an axle 18X. The shape of the arcuate loop connector 18C conforms to the shape of the cover portion 14. In the embodiment of FIG. 1 the legs 18L and connecting portion 18C of the bail are rectangular in cross section while the axle 18X is circular in cross section, for a reason be be developed. It should be understood, however, that all regions of the bail may exhibit the same cross sectional configuration.

In accordance with the present invention the clamping bail member 18 is mountable into a clamping position over the conjoined cover 14 and the body 12 with the major axis 18A of the bail being at least generally parallel with the major axis of the adapter (with substantial parallelism being more preferred and collinearity most preferred). In the clamping position the bail 18 abuts against the stop surface(s) $22S_1$, $22S_2$ provided on the body 12 and the stop surface 28S provided on the cover 14, whereby the cover 14 is held to the body 12 in a manner such that the seal 16 (however arranged on the flange 14F) is compressed between the body and the cover. The plane of joinder between the surfaces 12S, 14S (on the body 12 and on the cover 14, respectively) should preferably lie perpendicular or at least substantially perpendicular to the axis of the adapter.

In the embodiment shown in FIG. 1 the clamping bail member 16 is pivotally mounted to the bottom end 12B of the body 12. Accordingly, the bottom 12B has a circular notch 12N (FIG. 3) provided therein. The axle portion 18X, which (as mentioned) is correspondingly circular in cross-section, is rotatably received within the notch 12N.

In use, the tube T is inserted into the interior opening 121 of the body 12 and the cover 14 having the seal 16 is introduced thereon. The tube T is thus received within the recess 34 defined by the body 12 and the cover 14 and supported for rotation therewithin. The seal 16 on the flange 14F slides inside the interior surface of the body portion 12 into a piston-type sealed relationship therewith (best seen in FIG. 2).

To maintain the seal 16 in position, the bail 18 is rotated in the direction of the arrow 42 from a first, open, position (shown in FIG. 1) to a second, clamping, position. As the bail 18 is rotated in the direction 42 the inside surfaces of the legs $18L_1$, $18L_2$ and the inner surface of the connecting portion 18C each respectively slide across the slide surfaces $24S_1$, $24S_2$ on of the body portion 12 and along the slide surface 30S on the cover 14 until the bail 18 is abutted against the associated respective stop surfaces $22S_1$, $22S_2$, and 28S. In this closed position the bail 18 secures the cover portion 14 to the body portion 14 compressing the seal 16 therebetween. A secondary seal is thereby provided in the event the liquid contained within the tube T escapes therefrom.

When in the clamping position the stop surfaces $22S_1$, $22S_2$, and 28S cooperate to support the bail 18 along its entire length. It should be noted that it lies within the contemplation of this invention to omit one or more of these stop surfaces, providing a stop surface on the body and/or on the cover. In such a case (where the bail is not supported along its entire length) the bail needs to be strong enough to withstand the bending imposed by centrifugal force.

Figure 2:
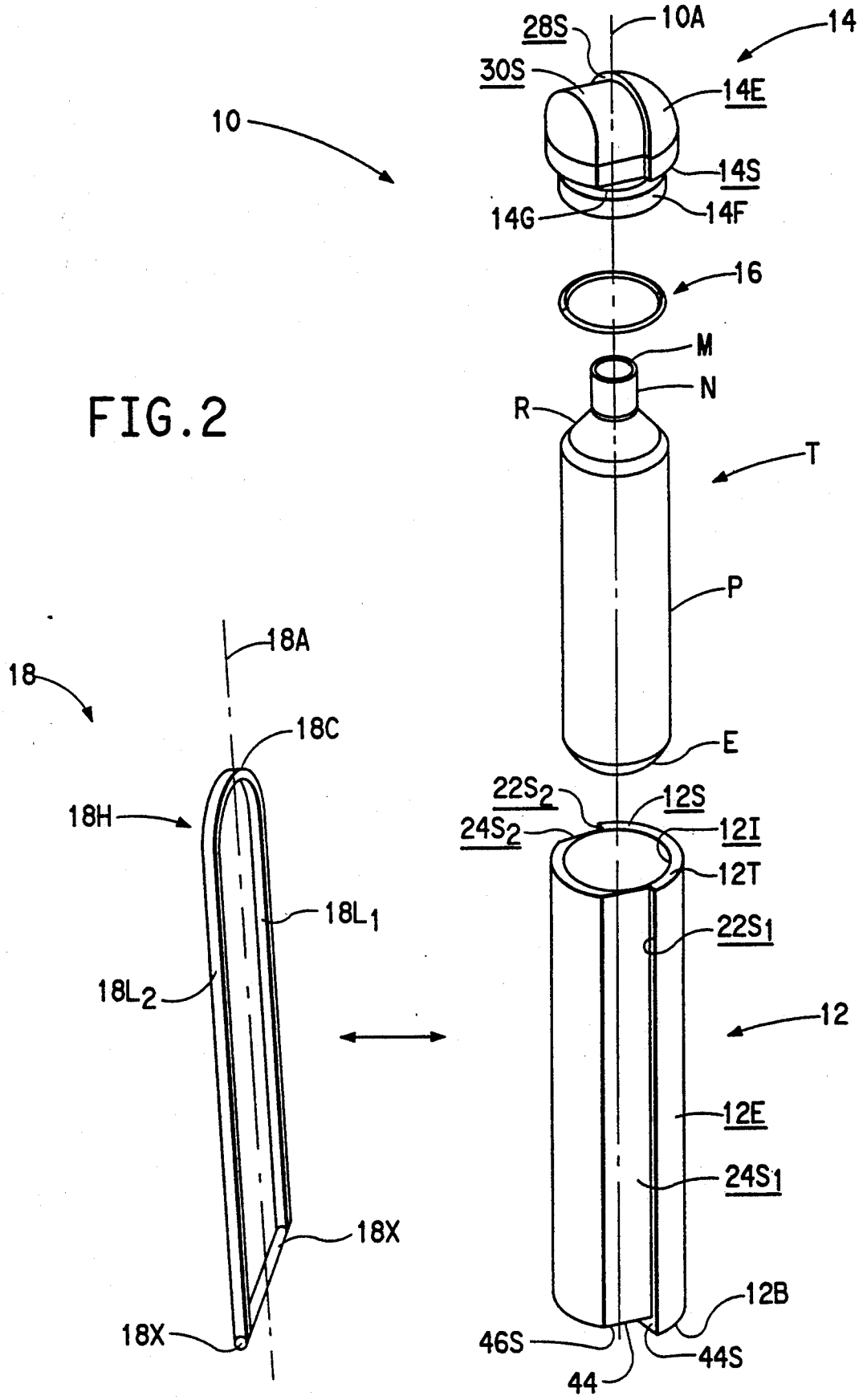
FIG. 2 is an exploded perspective view of a second embodiment of an adapter of the present invention in which the clamping bail member is separate from the body and cover.

As may be best seen in FIGS. 2 and 3, the adapter 10, when disposed in the cavity C of the rotor R is oriented such that the stop surfaces $22S_1$, $22S_2$, and 28 lie substantially normal to a radius r of the rotor through the center of the cavity C in which the adapter is disposed (FIG. 3).

To insure that this orientation of the adapter 10 within the cavity C is achieved, it may be desirable to key the adapter to insure the proper orientation of the same with respect to the cavity. One expedient whereby the adapter is keyed with respect to the cavity is to provide the entire height, or at least a predetermined portion of the height, of the rotor cavity with a noncircular configuration. As may be seen in FIGS. 6 through 8, for such cases the adapter 10 may be modified so that it exhibits a shape that corresponds to the noncircular configuration of the rotor cavity.

Figure 7:
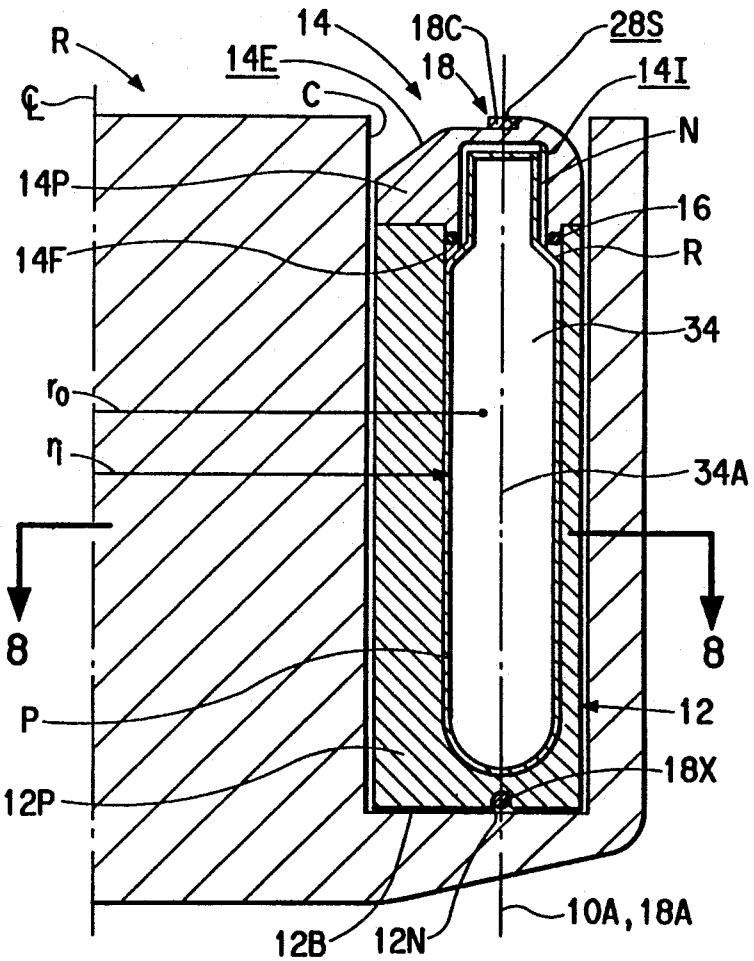
Figure 6:
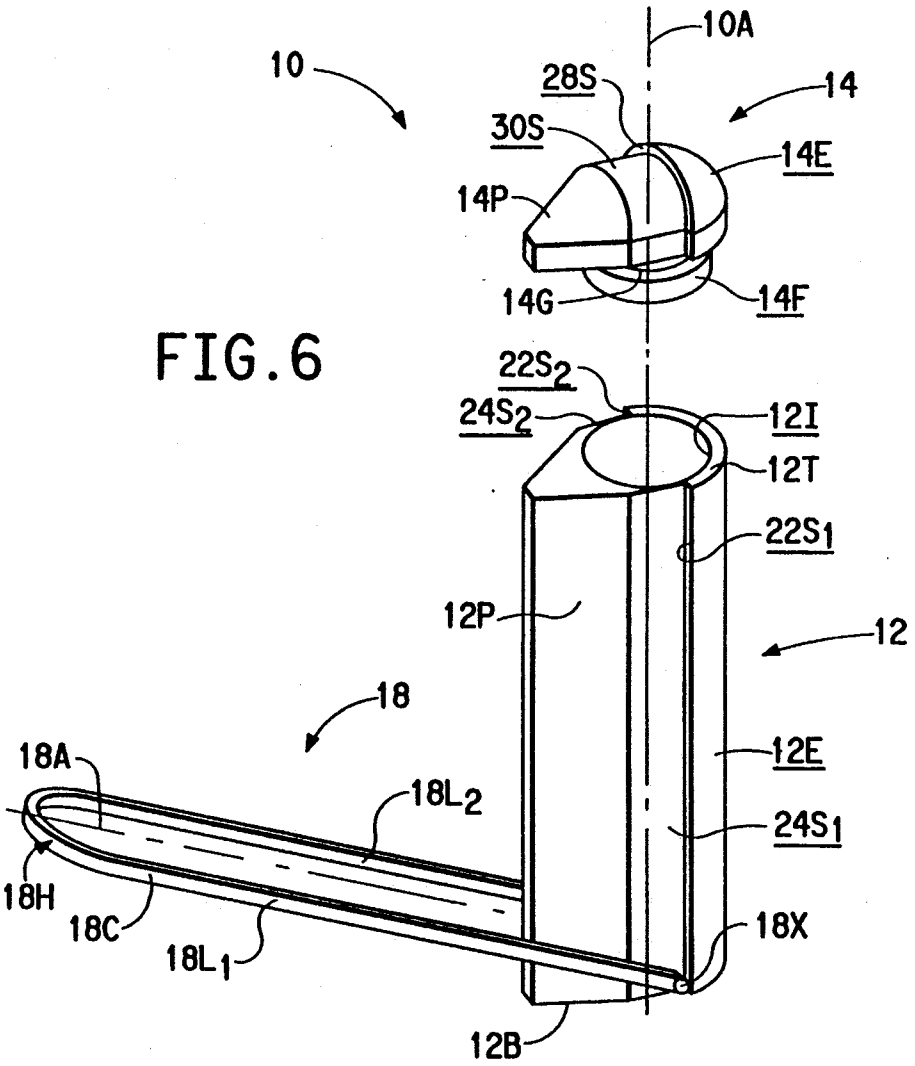
FIG. 6 is an exploded perspective view of a modification of the embodiments of the adapter shown in FIGS. 1 and 2 useful in a centrifuge rotor having a cavity with a predetermined noncircular configuration, with the body and/or the cover being shown as configured to match the configuration of the rotor cavity.
Figure 7A:
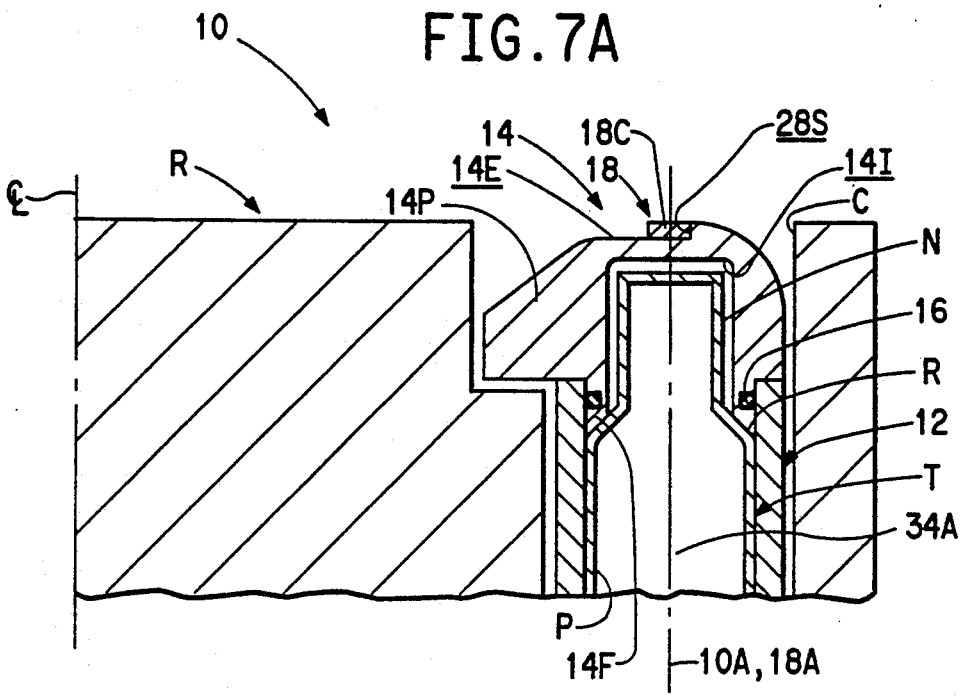
FIG. 7A illustrates the adapter of FIG. 6 in a cavity in which only a portion thereof has a predetermined noncircular configuration.
Figure 8:
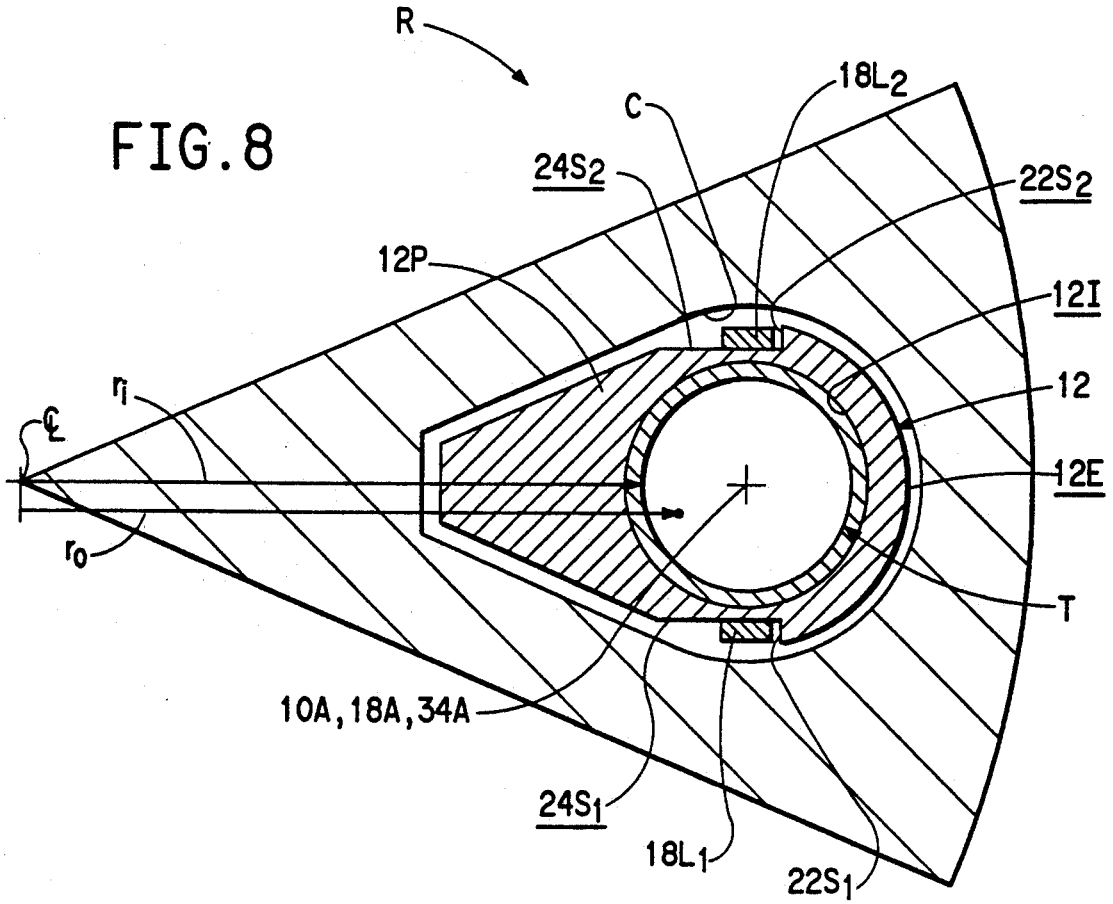
FIG. 8 is a section view taken along section lines 8—8 in FIG. 7.

As seen in FIGS. 6, 7 and 8, both the cover 14 and the body 12 (or some appropriate portion thereof) of the adapter 10 are provided generally triangular keying portions 14P, 12P respectively thereon. The keying portions 14P, 12P are provided to preclude rotation of the adapter within the cavity about the axis of the adapter. In the event that only the uppermost portion of the cavity C exhibits the noncircular configuration, then only the keying portion 14P on the cover 14 need be provided (FIG. 7A).

Whether disposed on the cover and/or body, if the keying portions 14P, 12P are located on the half of the cover and/or body that is close to the axis of rotation (i.e., the "radially inboard half" of the cover and/or body), as shown in FIGS. 7 through 8, then the keying portions 14P, 12P need not closely match the noncircular configuration of the rotor cavity C of the centrifuge rotor R in which the adapter 10 is disposed, so long as rotation of the adapter within the cavity is precluded. However, in such a case, the half of the cover and/or body that is distal from the axis of rotation (i.e., the "radially outboard half" of the cover and/or body), must closely correspond in size and shape to the cavity C.

If the keying portions 14P, 12P are located on the radially outboard half of the cover and/or body, then the keyed exterior surface 12E must closely correspond in size and shape to the cavity C of the centrifuge rotor R in which the adapter 10 is disposed.

Assuming that the adapter is inserted into the cavity in the orientation illustrated, during operation of the rotor, centrifugal force acts on the legs 18L$_1$. 18L$_2$ and the connection portion 18C of the bail 18 to urge those portions radially outward against the respective stop surfaces 22S$_1$, 22S$_2$, and 28S. These mentioned stop surfaces, when oriented normal to a radius of the rotor through the rotor cavity, serve both to maintain the bail in the clamping position and to support it against bending along its entire length.

As the rotor accelerates towards its operating speed, the pressure of the liquid sample in the tube increases. The tube, typically a thin wall tube made of a plastic material, is supported by the adapter 10 to contain the liquid under pressure. The transition region R of the tube T contacts with the conforming interior surface of the opening 141 of the cover portion 14 of the adapter 10. The cover 14 is thus urged upwardly from the force of the tube. The bail 18 must exhibit sufficient strength to withstand the upward force imposed on the cover by the pressure of the liquid in the tube to retain the cover in the closed position relative to the body 12 and to maintain the seal in the compressed state therebetween.

Whether a given bail is of sufficient strength, and thus falls within the scope of the claims of the present invention, can be determined from various readily ascertainable operating parameters of the rotor in which the adapter is to be used and the application to which the adapter is to be put. These parameters are the specific weight of the liquid sample within the tube received by adapter, the radius $r_i$ which represents the minimum distance to the sample from the axis CL of rotation (FIG. 8), the dimensions of the legs 18L$_1$, 18L$_2$ of the bail 18, the inside diameter of the tube T, and the speed of rotation of the rotor R.

The pressure at any location across the diameter of the tube in which the liquid sample is disposed is $$P = \frac{\omega^2}{2g}\,\alpha(r_o^2 - r_i^2) \qquad (1)$$

where

P is the pressure (Lb per inch$^2$), $\omega$ is the rotational velocity of the rotor (radians per second), g is acceleration due to gravity (inches per second$^2$), $\alpha$ is the specific weight of the sample (Lb per inch$^3$), $r_o$ is the distance to the point of interest x where the pressure value is desired from the center of rotation (inches), and $r_i$ is the minimum distance to the sample from the axis A of rotation (inches).

The total vertical force $F_V$ that the bail must withstand is then found by integrating this pressure function over the cross sectional area of the inside of the tube.

Knowing the dimensions of the legs of the bail and the force $F_V$, the average stress in the legs of the bail can be determined in accordance with the relationship:

$$s = \frac{F_V}{2A} \qquad (2)$$

where s is the stress (psi), $F_V$ is the force (Lbf)

A is the cross sectional area of each leg of the bail.

Based on the identity of the material used in the given adapter, the modulus of elasticity of that material may be readily obtained. An estimation of the vertical deformation of the legs of the bail may be found by multiplying the initial length of the bail by the average stress divided by the modulus of elasticity of the adapter material. If the average stress calculated in Equation (2) is less than the ultimate strength of the adapter material, and the predicted deformation is less than the deformation that will cause first leakage in the tube carried within the adapter, then the given bail is to be construed to have sufficient strength for at least one operating cycle, and therefore falls within the contemplation of the present invention. The determination of sufficient strength as set forth above under operating conditions will verify both the analysis and the conclusion of the sufficiency of strength of the adapter.

In view of the foregoing it should be readily appreciated that the ability of the bail 18 to withstand the upwardly directed (in the view of FIG. 2) tensile force eliminates the necessity of a separate capping arrangement for the cavity C. Moreover, the present adapter carries the further advantage of providing a secondary seal against the release of potentially hazardous aerosols. Improper loading and sealing of the tube, and manufacturing defects in the manufacture of the tube may lead to the failure of a tube during operation of the rotor. The seal of the adapter serves to contain the sample within the interior of the adapter should any sample exit the tube. After the conclusion of a centrifuge run, the adapters should be removed from the rotor and opened under a laminar flow hood to check for any tube failures. In the event of a tube failure, adapters containing no seal cannot contain any leaked sample during operation of the rotor thereby permitting the exit of potentially dangerous aerosols into the lab environment.

It should be understood that the bail 18 may be fixedly attached (i.e., nonrotationally mounted) at the bottom end 12B of the body 12. In this event, the legs 18L of the bail should exhibit resiliency sufficient to permit them to flex to allow the cover to be mounted to or removed from the body. A bail with legs of sufficient resiliency is to be construed as being "pivotally mounted" to the body. The bail 18 may also be pivotally mounted (as that term is used herein) to the cover 14.

Figure 4:
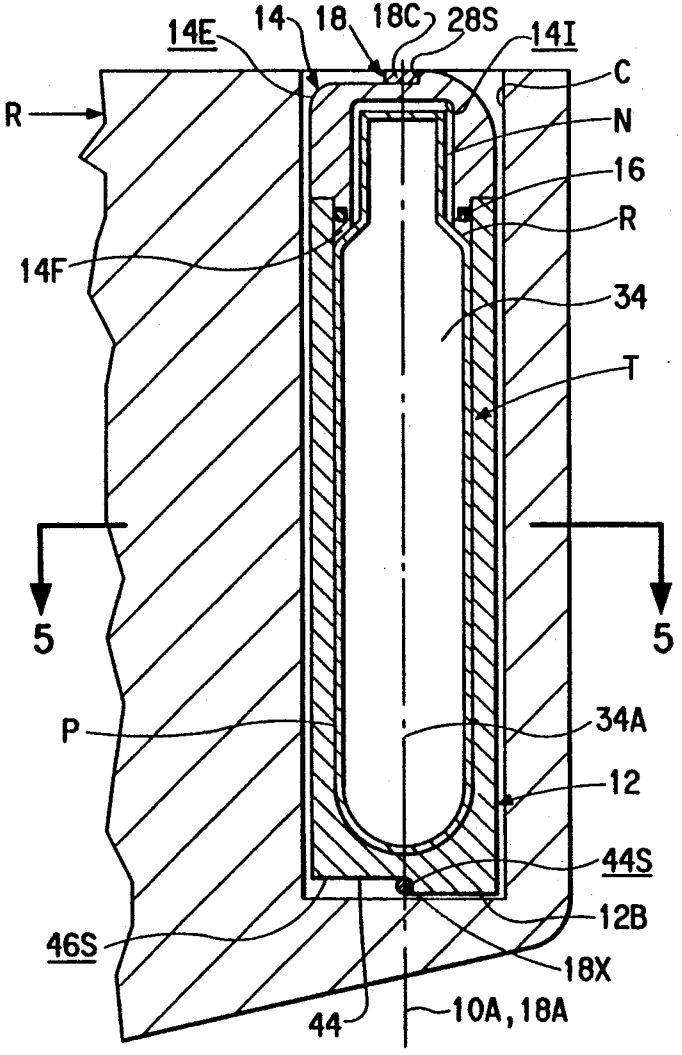
Figure 5:
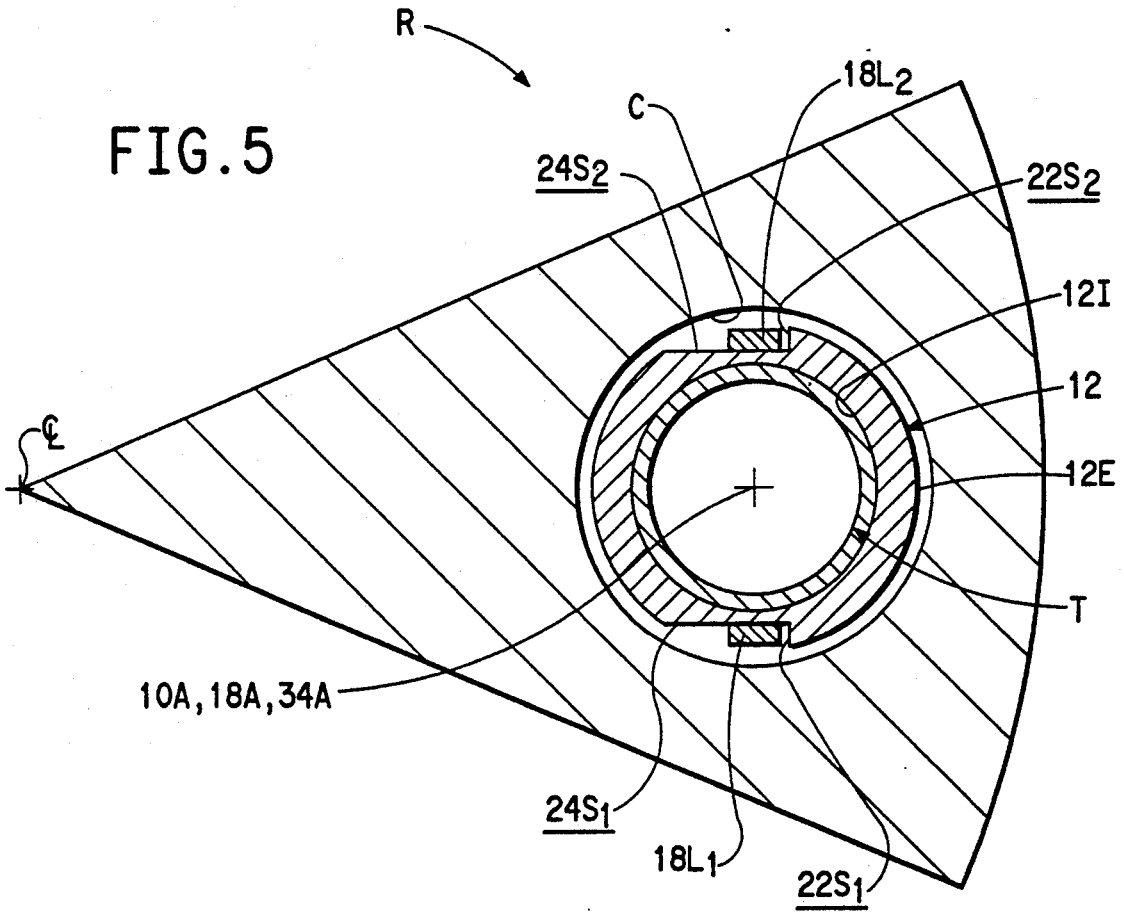
FIG. 5 is a section view taken along section lines 5—5 in FIGS. 3 and 4.
Figure 9:
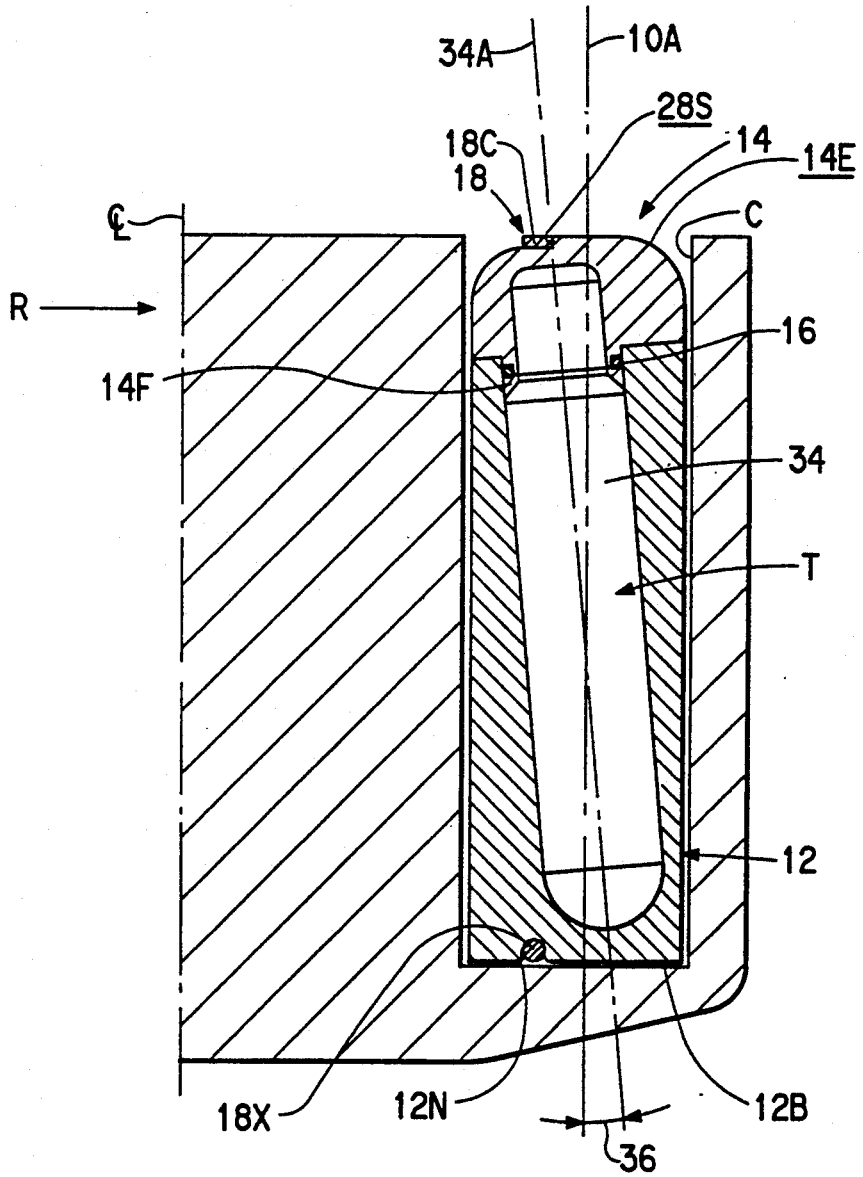
FIG. 9 is a section view similar to that shown in FIGS. 3, 4 and 7 wherein the body of the adapter is modified such that axis of the recess of the adapter is inclined at a near vertical angle with respect to the axis of rotation.

Alternatively, it lies within the contemplation of this invention to maintain the bail 18 as an element separate from the body and cover until the bail 18 is mounted thereon. Such an alternative embodiment is shown in FIGS. 2, and 4. In this embodiment a portion of the bottom end 12B of the body 12 is undercut, as at 44, to define a stop surface 44S and a slide surface 46S thereon. In use, the bail 18 is slidably mounted into clamping position (FIGS. 4, 5) over the conjoined cover 14 and body 12. The bail 18 is of sufficient strength and serves to hold the cover to the body in a manner that compresses the seal 16 therebetween, all as is discussed above. It should be clear that the axis 34A of the recess 34 defined within the adapter of the embodiment of FIGS. 2, 4 and 5 may alternatively be inclined with respect to the axis 10A of the adapter, as is illustrated in FIG. 9. Furthermore, the adapter of the embodiment of FIGS. 2, 4 and 5 may exhibit the keying arrangement as discussed in connection with FIGS. 6 through 8.

As a result of the use of an adapter in accordance with the present invention, a threaded cavity capping assembly may be ommitted.

Those skilled in the art having the benefit of the teachings of the present invention as hereinabove set forth may effect numerous modifications thereto. Such modifications are construed to lie within the contemplation of the present invention as defined by the appended claims.

What is claimed is:

1. An adapter for supporting a single closed centrifuge tube within a cavity in a centrifuge rotor, the adapter comprising:

a body having an exterior surface, an open first end and a closed second end;

a cover having an exterior surface thereon, the cover being mountable to the open end of the body, the body and the cover each having an opening therein that cooperate to define a recess sized to totally surround the centrifuge tube when the cover is mounted to the body, the adapter having a major axis extending therethrough;

the body having at least a first stop surface thereon, the first stop surface extending axially along the body;

a seal disposed between the cover and the body; and a bail having a major axis extending therethrough, the bail being slidably mountable into a clamping position over the cover and the body, in the clamping position the bail abutting against the stop surface with the major axis of the bail being at least generally parallel with the major axis of the adapter, whereby the seal is compressed therebetween.

2. The adapter of claim 1 wherein the major axis of the bail is substantially parallel to the major axis of the adapter when the bail is in the clamping position.

3. The adapter of claim 1 wherein the major axis of the bail is collinear with the major axis of the adapter when the bail is in the clamping position.

4. The adapter of claim 1 wherein the stop surface is also disposed on the cover and wherein the stop surface extends substantially the full length of the body.

5. The adapter of claim 1 wherein the stop surface disposed on the body extends substantially the full length thereof.

6. The adapter of claim 5 wherein the body has a second stop surface thereon, the second stop surface being diametrically opposed with respect to the first stop surface and extending substantially the full length of the body.

7. The adapter of claim 1 wherein the recess has an axis extending therethrough, the axis of the recess being inclined at a predetermined angle with respect to the major axis of the adapter.

8. The adapter of claim 1 wherein the bail is formed of a material having sufficient strength to withstand a vertical force created by the pressure of a liquid carried in the tube under centrifugation.

9. The adapter of claim 1 wherein the cavity of the rotor has an upper portion having a predetermined noncircular shape, and wherein the exterior surface of the cover has a shape that cooperates with the noncircular cavity to preclude rotation of the adapter within the cavity.

10. The adapter of claim 1 wherein the cavity of the rotor has a predetermined noncircular shape, and wherein a portion of the exterior surface of the body has a shape that cooperates with the noncircular cavity to preclude rotation of the adapter within the cavity.

11. The adapter of claim 1 wherein the bail is pivotally mounted to one of the cover or the body.

12. An adapter for supporting a single closed centrifuge tube within a cavity in a centrifuge rotor, the adapter comprising:

a body having an exterior surface, an open first end and a closed second end;

a cover having an exterior surface thereon, the cover being mountable to the open end of the body, the body and the cover each having an opening therein that cooperate to define a recess sized to totally surround the centrifuge tube when the cover is mounted to the body, the adapter having a major axis extending therethrough;

at least the body having a first and a second stop surface thereon, the stop surfaces being diametrically disposed on the body and extending axially therealong;

a seal disposed between the cover and the body; and a bail pivotally mounted to the second end of the body, the bail being pivotally movable from an open to a clamping position, the bail having a major axis extending therethrough, in the clamping position, the bail abutting against the stop surfaces with the major axis of the bail being at least generally parallel with the major axis of the adapter, whereby the cover is held to the body in a manner that compresses the seal therebetween.

13. The adapter of claim 12 wherein the major axis of the bail is substantially parallel to the major axis of the adapter when the bail is in the clamping position.

14. The adapter of claim 12 wherein the axis of the bail is collinear with the axis of the recess when the bail is in the clamping position.

15. The adapter of claim 12 wherein a stop surface is also disposed on the cover and wherein the stop surfaces on the body extend substantially the full length thereof.

16. The adapter of claim 12 wherein the stop surfaces on the body extend substantially the full length thereof.

17. The adapter of claim 12 wherein the recess has an axis extending therethrough, the axis of the recess being inclined at a predetermined angle with respect to the major axis of the adapter.

18. The adapter of claim 12 wherein the bail is formed of a material having sufficient strength to withstand a vertical force created by the pressure of a liquid carried in the tube under centrifugation.

19. The adapter of claim 12 wherein the cavity of the rotor has an upper portion having a predetermined noncircular shape, and wherein the exterior surface of the cover has a shape that cooperates with the noncircular cavity to preclude rotation of the adapter within the cavity.

20. The adapter of claim 12 wherein the cavity of the rotor has a predetermined noncircular shape, and wherein a portion of the exterior surface of the body has a shape that cooperates with the noncircular cavity to preclude rotation of the adapter within the cavity.

* * * * *